US005562042A

United States Patent [19]

Luck et al.

[11] Patent Number: 5,562,042

[45] Date of Patent: Oct. 8, 1996

[54] ELASTIC MEMBRANE

[75] Inventors: Gerald Luck, Wiechs am Randen; Thomas Schlusemann, Gottmadingen; Hans H. Engelhardt, Oehningen, all of Germany

[73] Assignee: Sig Schweizerische Industriegesellschaft, Switzerland

[21] Appl. No.: 387,789

[22] PCT Filed: May 24, 1994

[86] PCT No.: PCT/CH94/00094

§ 371 Date: Mar. 23, 1995

§ 102(e) Date: Mar. 23, 1995

[87] PCT Pub. No.: WO95/00381

PCT Pub. Date: Jan. 5, 1995

[30] Foreign Application Priority Data

Jun. 17, 1993 [CH] Switzerland ..... 1806/93

[51] Int. Cl.[6] ..... B60D 5/00

[52] U.S. Cl. ..... 105/8.1; 105/15; 105/18

[58] Field of Search ..... 105/8.1, 15, 18, 105/19, 20, 458; 280/403

[56] References Cited

U.S. PATENT DOCUMENTS

| | | | |
|---|---|---|---|
| 2,200,341 | 5/1940 | Rahr | 52/515 X |
| 2,578,140 | 12/1951 | Krupp et al. | 105/15 |
| 3,294,387 | 12/1966 | Chavannes | 267/145 |
| 5,033,395 | 7/1991 | Bechu et al. | 280/403 X |

FOREIGN PATENT DOCUMENTS

| | | | |
|---|---|---|---|
| 285162 | 10/1988 | European Pat. Off. . | |
| 0389934 | 3/1990 | European Pat. Off. . | |
| 2457634 | 6/1976 | Germany | 105/8.1 |
| 3541367 | 6/1986 | Germany . | |

*Primary Examiner*—Robert J. Oberleitner
*Assistant Examiner*—Kevin D. Rutherford
*Attorney, Agent, or Firm*—Ostrolenk, Faber, Gerb & Soffen, LLP

[57] ABSTRACT

The elastic membrane is designed as a flat, three-dimensional object. It has prominences and depressions. This makes possible a deformation which is substantially free of stress, in particular free of tensile stress, simultaneously in all three dimensions. The elastic membranes of this type which are known today suffer from the disadvantage that they are not substantially free of stress, and in particular free of tensile stress, in all three dimensions and therefore cannot meet certain requirements.

9 Claims, 3 Drawing Sheets

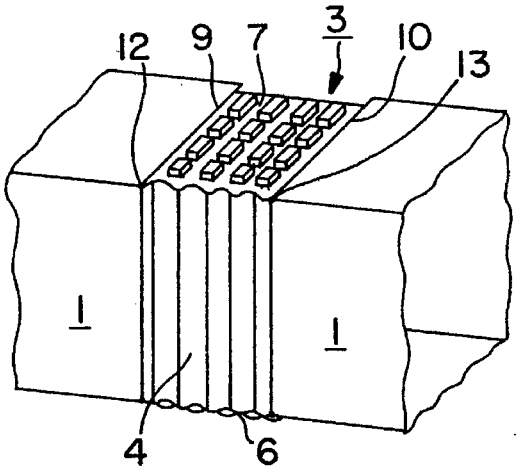
FIG. 1(a)
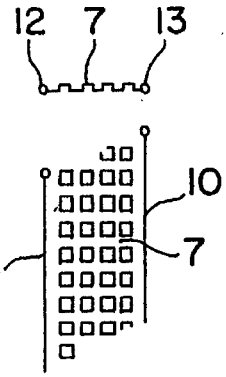
FIG. 1(b)
FIG. 1(c)
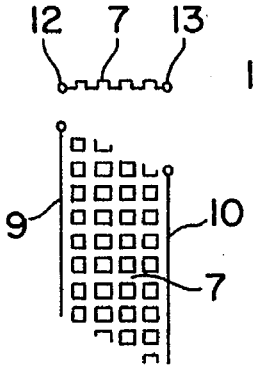
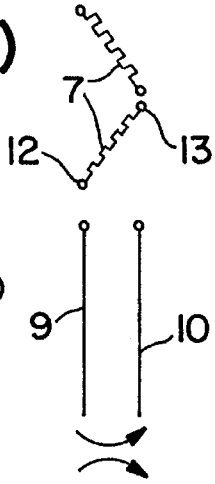
FIG. 1(d)
FIG. 1(e)
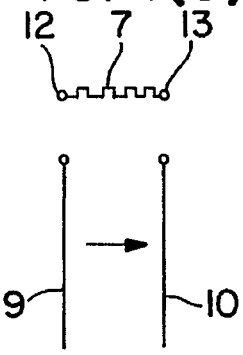
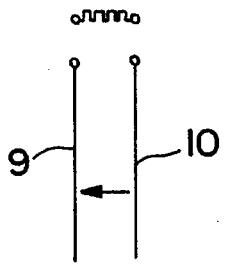
FIG. 1(f)
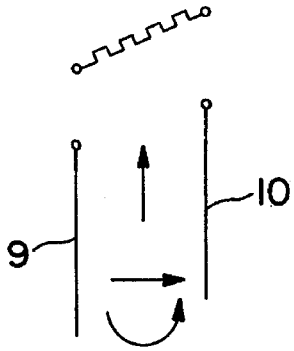
FIG. 1(g)
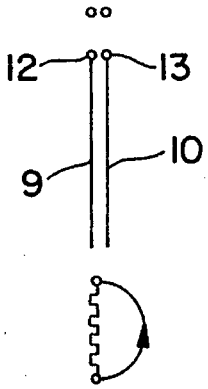
FIG. 1(h)

ELASTIC MEMBRANE

BACKGROUND OF THE INVENTION

1. Field of the Invention

The present invention relates to an elastic membrane.

Such membranes are used, in particular, for the joining of the ends of railway cars in such a manner that they are protected from the air and the weather.

2. Description of the Related Art

The prior art includes elastic walls, for instance intermediate walls between two rail cars. They are intended to form a closure against the weather, smoke and dust. These walls comprise an externally visible plate of highly elastic material, for instance highly elastic rubber. On the inside of this plate there is fastened to the plate an undulated fabric which is embedded in plastic material, such as rubber or similar material.

Upon the displacement with respect to each other of the ends of the cars which are equipped with a connecting transition consisting of this material, for instance around curves, the outer plate is stretched due to its elasticity, the inner layer being also extended and the folds or corrugations being flattened until the inner layer is also in its final stretched condition, so that the extension of the wall is at an end.

A second such wall construction is present on the inner side of the first wall, the surface facing towards the inside being again developed as a flat, sheet-shaped surface, and the folds or undulated layer being fastened in this manner which has been described.

This elastic intermediate wall will absorb, with considerable elastic deformation, the stressing occurring in the longitudinal direction of the train, especially around curves, as a result of the increase in spacing between the parts of the car to the outside of the curve. However, such deformation is not possible in any other direction, for instance in height or laterally, since the inner surface with fabric insert selected does not permit this, in view of its construction and shape (U.S. Pat. No. 2,578,140).

An annular attachment of two cars in the form of a flexible covering is also known. It consists of two parts each connected to one of the vehicle ends. The two-part covering is provided with transverse corrugations which serve to compensate for a change in distance between the two ends of the car in the direction of travel. However, this transverse corrugation only inadequately permits three-dimensional changes in position of the ends of the two cars relative to each other. This possibility of adaptation of shape upon a three-dimensional relative change in position of the ends of the cars is necessary in particular when the two ends of the cars are relatively close to each other, or the intervening space is only of slight width (Federal Republic of Germany A 35 41 367).

The elastic membranes of this type which are known today have the disadvantage that they are not substantially free of stress, in particular free of tensile stress, in all three dimensions and therefore cannot meet certain requirements.

SUMMARY OF THE INVENTION

The object of the present invention is an elastic membrane which can be deformed in all three directions, i.e. three-dimensionally in the direction necessary in each case, substantially free of stress.

BRIEF DESCRIPTION OF THE DRAWINGS

The invention will be described below, by way of example, with reference to the drawing, in which:

FIG. 1*a* is a perspective view showing diagrammatically the ends of two rail car bodies between which an elastic membrane bellows according to the present invention is arranged;

FIGS. 1(*b*)–1(*h*) are top inside views schematically showing the ends of two rail car bodies with car ends shifted;

DETAILED DESCRIPTION OF THE PREFERRED EMBODIMENTS

Figure 2:
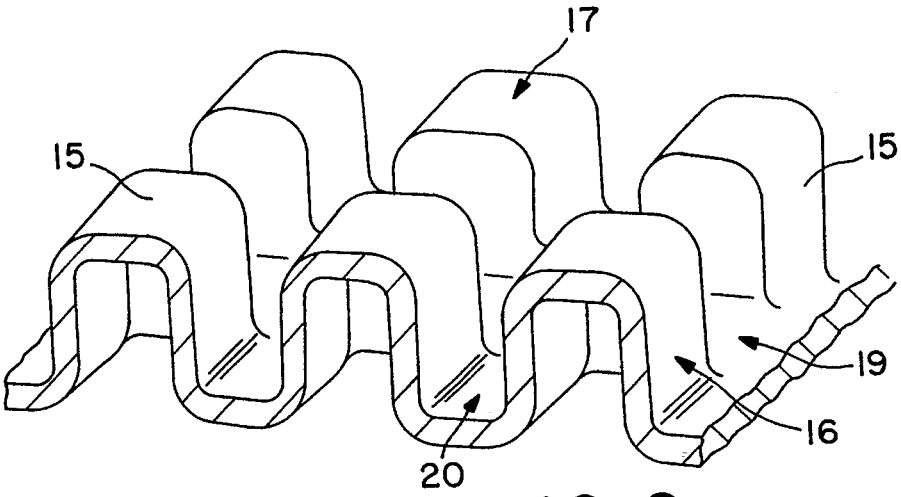
FIG. 2 is a perspective view of part of an embodiment of an elastic membrane according to the present invention.

FIG. 1 shows the ends 1 of two rail cars, the ends being connected to each other by a connecting bellows 3. This bellows has two side surfaces 4 which are corrugated in the direction of travel, as well as a bottom surface 6 and a top surface 7 which have prominences. The top edges of the cars are designated 9 and 10, and their displacements correspond to the displacements of the two ends 1 of the rail cars, seen in top view and in side view in FIGS. 1(*b*)–1(*h*).

As shown in FIGS. 1(*a*)–1(*h*), the bottom surface 6 bearing the prominences and the top surface 7 also bearing the prominences can be changed in shape in three directions substantially free of stress and thus regardless of the mutual position of the ends 1, whereby movements can take place substantially with minimum stresses. In this way, not only is the life of the connecting bellows correspondingly increased, but the danger of a sudden tear, even upon impact-like changes, is extremely slight.

FIG. 2 shows an embodiment of an elastic membrane having prominences 15 which are arranged in longitudinal rows of prominences 16 and transverse rows of prominences 17. Longitudinal valleys 19 and transverse valleys 20 lie between the respective rows of prominences. This membrane is also three-dimensionally deformable, this taking place to the necessary extent substantially free of stress. These membranes consist of suitable grades of rubber which, however, permit the necessary possibilities of deformation, and therefore the properties of the material and the shape of the prominences must be selected accordingly. In the embodiment of the invention shown in FIG. 2, the elastic membrane has a substantially constant thickness. Alternatively, the longitudinal and transverse rows of prominences can also be staggered with respect to each other.

Figure 3:
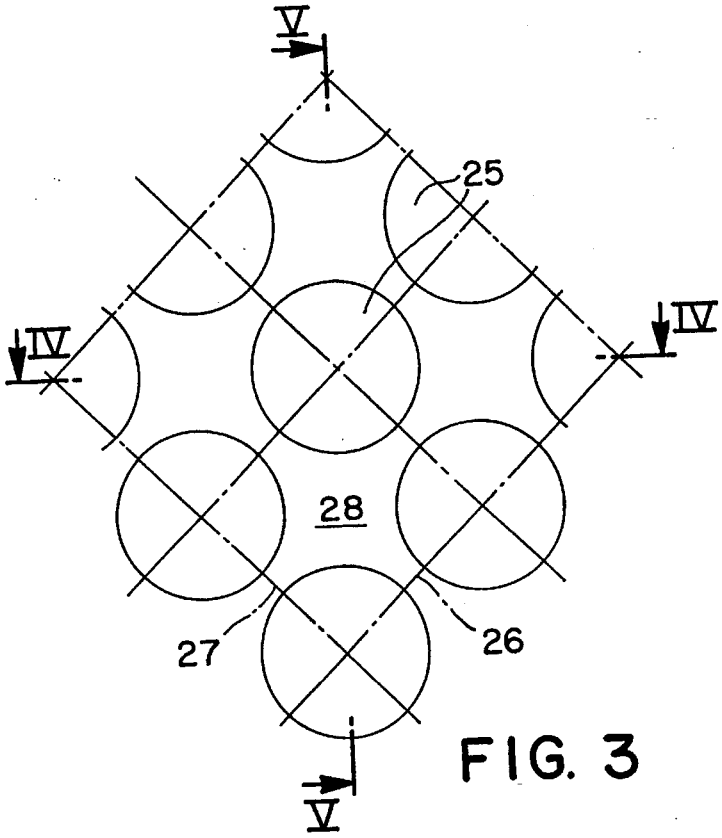
FIG. 3 is a top view of an elastic membrane according to the present invention having prominences of circular cross section.
Figure 5:
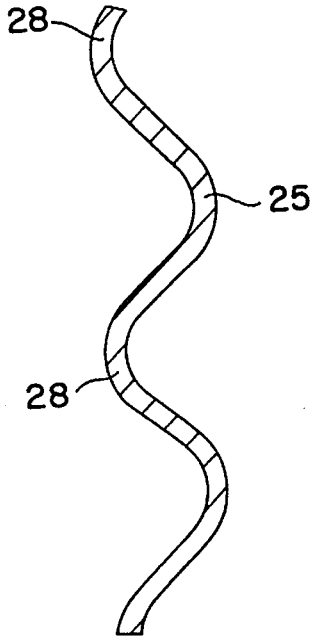
FIG. 5 is a section along the section line V—V of FIG. 3.
Figure 4:
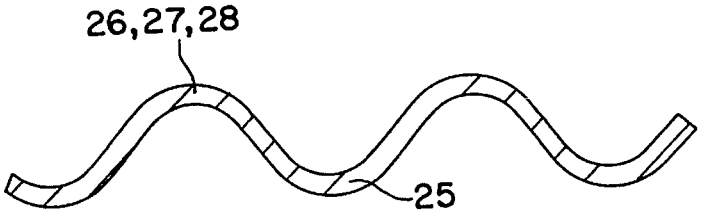
FIG. 4 is a section along the two section lines IV—IV of FIG. 3.
Figure 6:
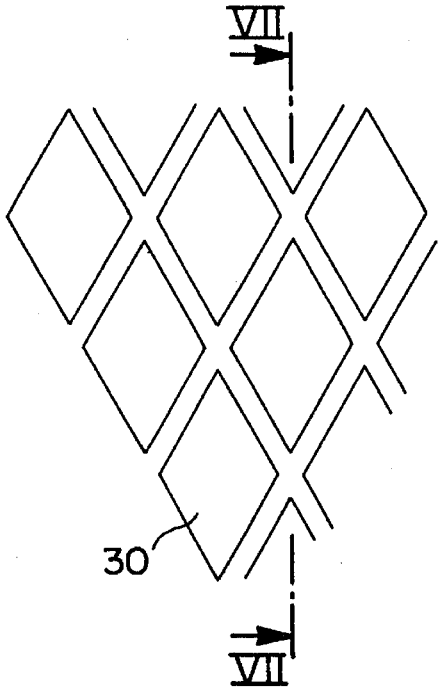
FIG. 6 is a view of an alternative embodiment of an elastic membrane according to the present invention having a different pattern.
Figure 7:
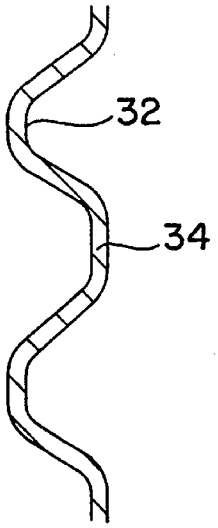
FIG. 7 is a section along the section line VII—VII of FIG. 6.
Figure 8:
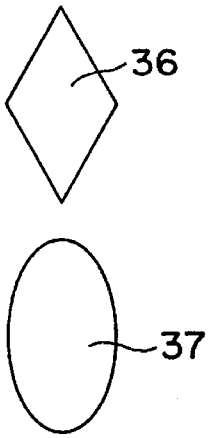
FIG. 8 is a schematic view of an elastic membrane according to the present invention having alternative, according to the present invention differently shaped prominences.

FIGS. 3 and 4 show another possible development of an elastic membrane, seen in plan view and in section. The prominences 25 have a round cross section. They are separated from each other by rows of valleys 26 and 27. These rows of valleys 26 and 27 meet at intersections 28. The prominences 25, arranged in rows, are at right angles to each other and are symmetrical. It is, of course, possible to select the angle of the rows differently, as can be noted, for instance, from the arrangement of diamond shapes 30 of FIG. 6. From the sectional view of FIG. 7, it can be noted that the prominences in the valleys are developed as pyramids 34 and valley-planes 32. While FIG. 6 shows diamond shapes, other shapes such as rhombuses, rhomboids, parallelograms, polygons, squares or rectangles can also be selected. Thus, FIG. 8 shows a view of an elastic membrane having different prominences, namely diamonds 36 and oval prominences 37. It is also possible, depending on the field of use, to develop such elastic membranes differently in different directions with respect to their deformation properties, which is achieved not only by the changing thickness of the material but also by corresponding arrangement of prominences and valleys and their shapes.

Figure 9:
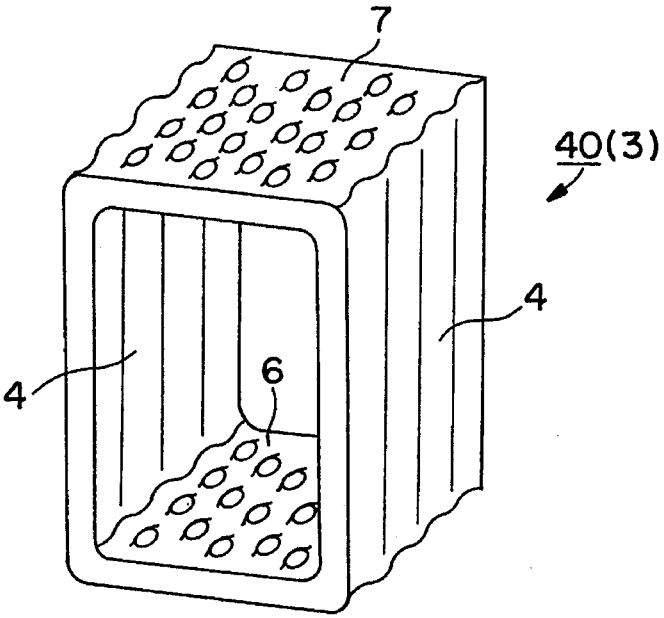
FIG. 9 is a perspective view of an elastic membrane bellows for installation between two inner ends of cars.

FIG. 9 shows an example of the use of such elastic membranes employed for railway-car transitions, the bellows-shaped transition 40 shown here having side parts with undulated side surfaces 4 as well as a bottom surface 6 with prominences and a top surface 7 with prominences, as explained previously w.r.t. the other figures.

Other variations of the elastic membrane are encompassed within the present invention. For example, rather than having a substantially uniform thickness on cross-section, the elastic membrane could having a cross-section with an irregular thickness. Further, the elastic membrane of the present invention could have its prominences arranged in an irregular pattern.

This embodiment of elastic membranes is extremely important, in particular, for the production of transitions between the inner ends of cars which are only a slight distance from each other, since large deformations can be withstood without damage, particularly in the case of transverse displacements.

Although the present invention has been described in relation to particular embodiments thereof, many other variations and modifications and other uses will become apparent to those skilled in the art. Therefore, the present invention should be limited not by the specific disclosure herein, but only by the appended claims.

We claim:

1. An elastic membrane bellows for enclosing the gap between two connected railroad cars comprising a single, free-standing sheet of flexible elastic material, the sheet having opposed outer surfaces having corresponding contours, the contours comprising hollow prominences and valleys arranged in at least two intersecting rows for enabling the flexible elastic material to change shape in one or more of three orthogonal directions substantially free of stress in any of the directions in response to deforming forces applied to the sheet of flexible elastic material.

2. The elastic membrane bellows of claim 1, wherein the flexible elastic material has a substantially constant thickness.

3. The elastic membrane bellows of claim 1, wherein the prominences and valleys are arranged in a regular pattern.

4. The elastic membrane bellows of claim 1, wherein the prominences have a cross-section selected from the group consisting of parallelograms, polygons, squares, rectangles, rhomboids, diamonds, circles, ovals and ellipses.

5. The elastic membrane bellows of claim 1, wherein the sheet of flexible elastic material has a cross-section taken parallel to a central axis of the prominences that is the same in each of two sectional planes formed at right angles to each other.

6. The elastic membrane bellows of claim 1, wherein each of the prominences is symmetric with respect to a central axis of each of the respective prominences.

7. The elastic membrane bellows of claim 1, wherein the elastic membrane encloses a top part and a bottom part of the gap between the two connected railroad cars, the elastic membrane bellows further comprising two flexible side parts corrugated only in the direction of travel.

8. The elastic membrane bellows of claim 1, wherein the sheet of flexible elastic material has opposed ends for attachment to proximate surfaces.

9. The elastic membrane bellows of claim 1, further comprising at least one railroad car connected to the sheet of flexible elastic material.

* * * * *